US009911309B1

(12) United States Patent
Kumagai

(10) Patent No.: US 9,911,309 B1
(45) Date of Patent: Mar. 6, 2018

(54) PERSONAL PROXIMITY WARNING DEVICE WHICH DETECTS MOTION PROXIMATE A USER

(71) Applicant: Randal K. Kumagai, Fort Huachuca, AZ (US)

(72) Inventor: Randal K. Kumagai, Fort Huachuca, AZ (US)

( * ) Notice: Subject to any disclaimer, the term of this patent is extended or adjusted under 35 U.S.C. 154(b) by 0 days.

(21) Appl. No.: 15/407,931

(22) Filed: Jan. 17, 2017

(51) Int. Cl.
*G08B 21/00* (2006.01)
*G08B 21/22* (2006.01)

(52) U.S. Cl.
CPC ..... *G08B 21/22* (2013.01)

(58) Field of Classification Search
CPC ..... G08B 21/22
USPC ..... 340/540, 573.1, 686.6; 381/55, 56
See application file for complete search history.

(56) References Cited

U.S. PATENT DOCUMENTS 4,973,944 A 11/1990 Maletta
7,356,473 B2 4/2008 Kates
8,633,814 B2 1/2014 Smith
D703,634 S 4/2014 Han
8,803,699 B2 8/2014 Foshee et al.
2009/0082071 A1* 3/2009 Hicks, III ..... G10K 11/1788 455/570
2011/0227728 A1 9/2011 Mathis
2012/0280824 A1* 11/2012 Zelepugas ..... H04R 1/1041 340/670
2015/0222977 A1 8/2015 Angel, Jr.

FOREIGN PATENT DOCUMENTS

WO WO9717043 5/1997

* cited by examiner

*Primary Examiner* — Jeffery Hofsass

(57) ABSTRACT

A personal proximity warning device for alerting a user to an approaching object includes a housing that defines an interior space. The housing is configured to couple to an article that is coupled to a user. A power module and a transmitter are coupled to the housing and positioned in the interior space. The transmitter is operationally coupled to the power module and is configured to communicate an alert to an electronic device of the user. The electronic device is configured to audibly communicate the alert to the user through one or more speakers that are coupled to the user, such as earbuds and headphones. A sensor is coupled to the housing and operationally coupled to the power module and the transmitter. The sensor is configured to detect motion in an area proximate to the user and to compel the transmitter to communicate the alert upon detection of the motion.

10 Claims, 4 Drawing Sheets

PERSONAL PROXIMITY WARNING DEVICE WHICH DETECTS MOTION PROXIMATE A USER

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to warning devices and more particularly pertains to a new warning device for alerting a user to an approaching object.

BRIEF SUMMARY OF THE INVENTION

An embodiment of the disclosure meets the needs presented above by generally comprising a housing that defines an interior space. The housing is configured to couple to an article that is coupled to a user. A power module and a transmitter are coupled to the housing and positioned in the interior space. The transmitter is operationally coupled to the power module and is configured to communicate an alert to an electronic device of the user. The electronic device is configured to audibly communicate the alert to the user through one or more speakers that are coupled to the user, such as earbuds and headphones. A sensor is coupled to the housing and operationally coupled to the power module and the transmitter. The sensor is configured to detect motion in an area proximate to the user and to compel the transmitter to communicate the alert upon detection of the motion.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
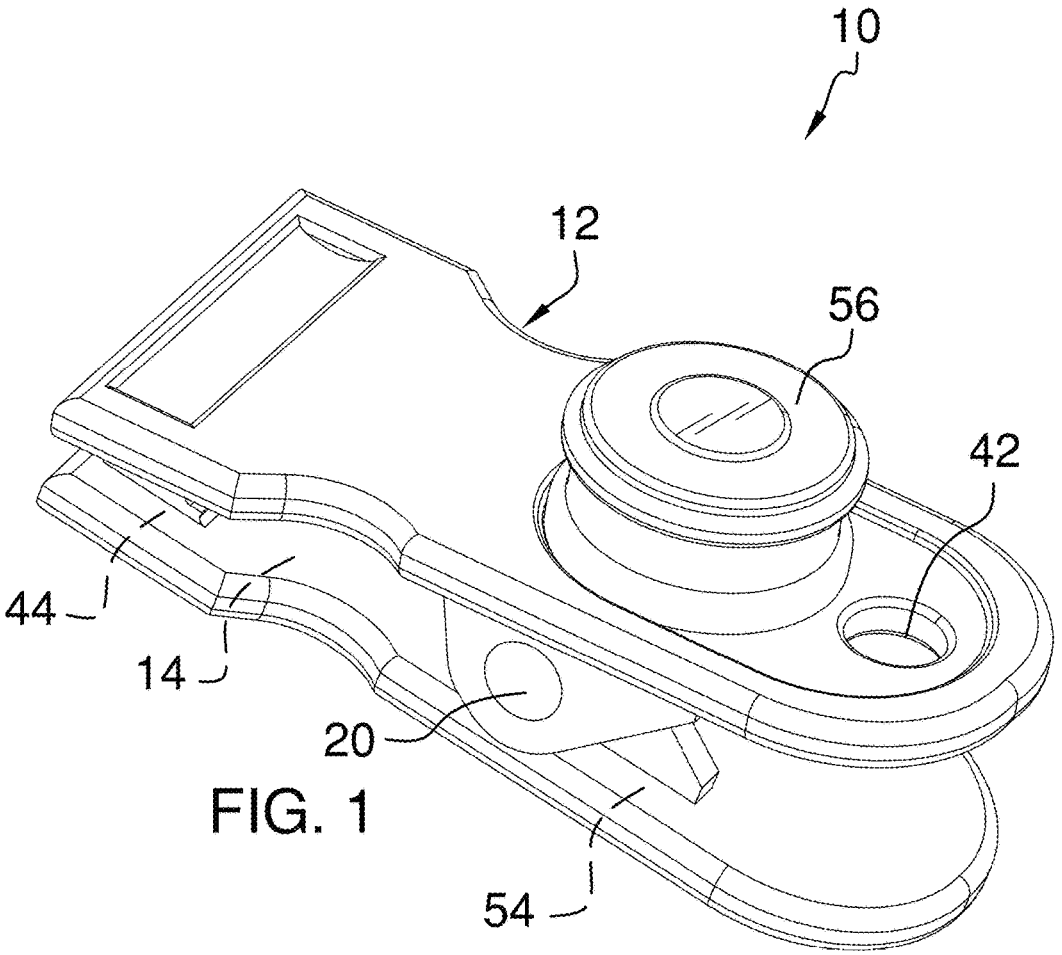
FIG. 1 is an isometric perspective view of a personal proximity warning device according to an embodiment of the disclosure.
Figure 2:
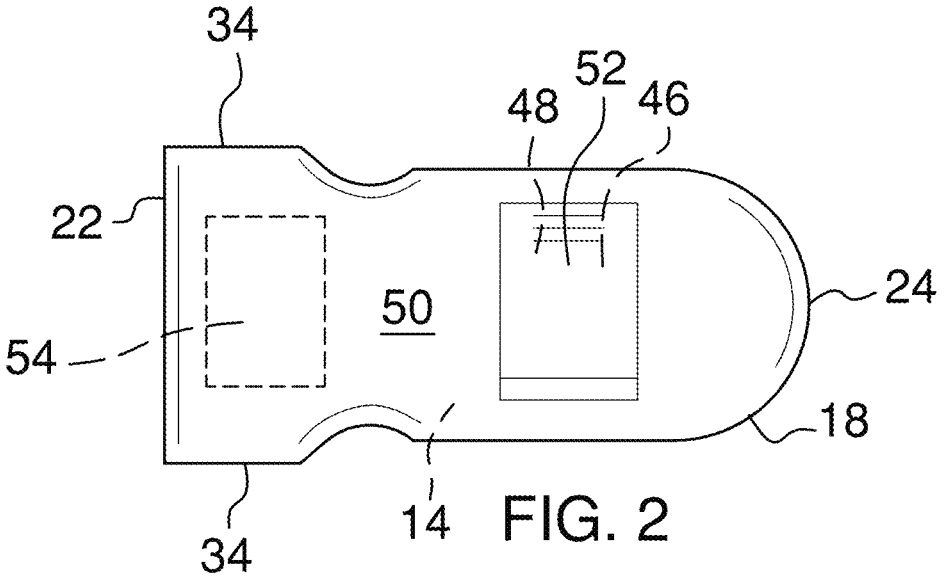
FIG. 2 is a bottom view of an embodiment of the disclosure.
Figure 3:
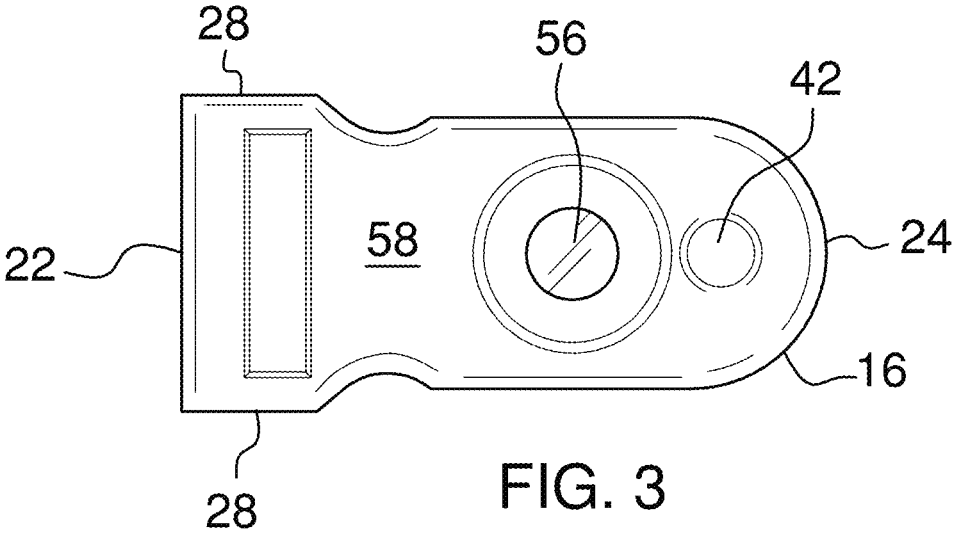
FIG. 3 is a top view of an embodiment of the disclosure.
Figure 4:
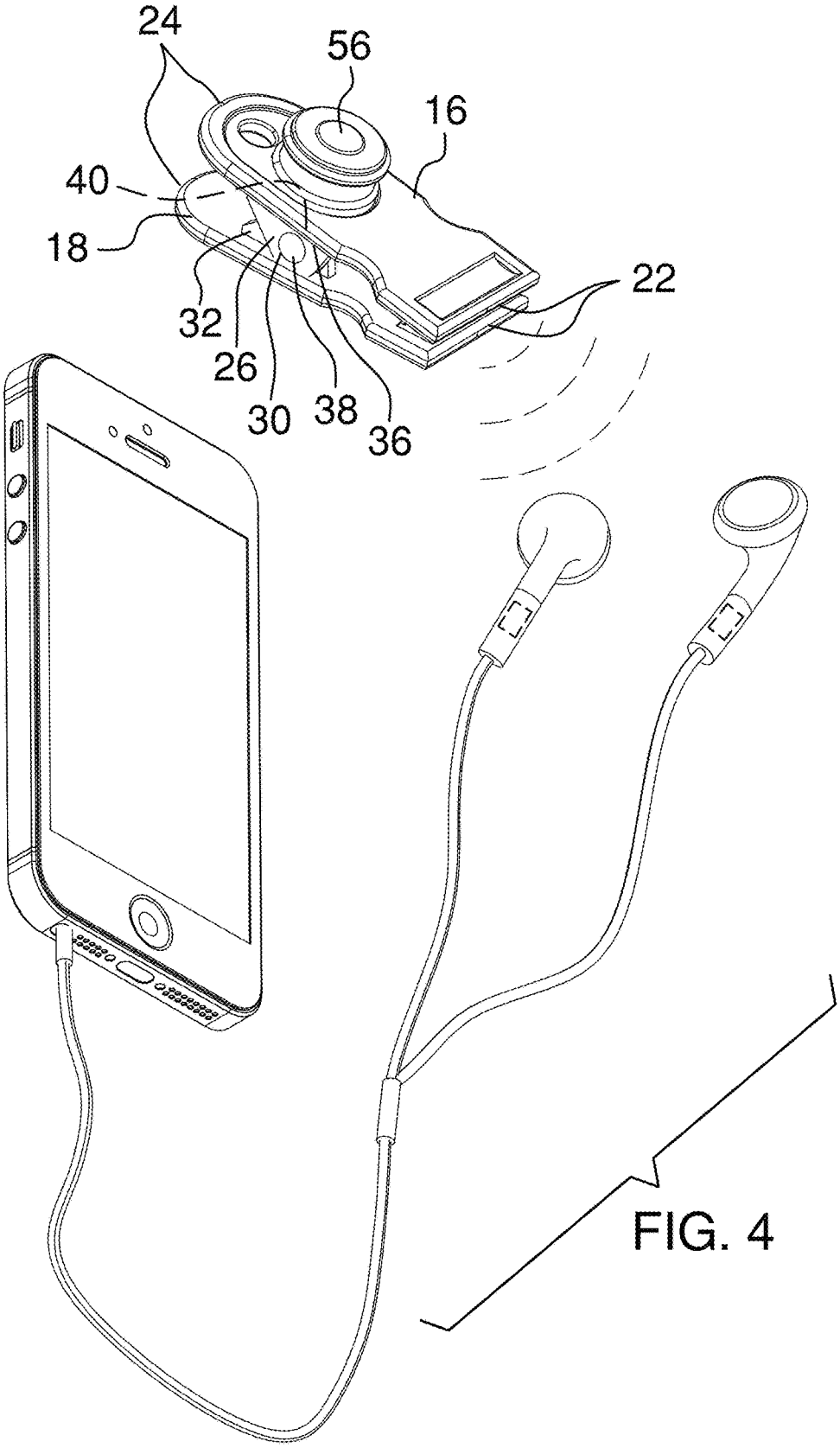
FIG. 4 is an in-use view of an embodiment of the disclosure.
Figure 5:
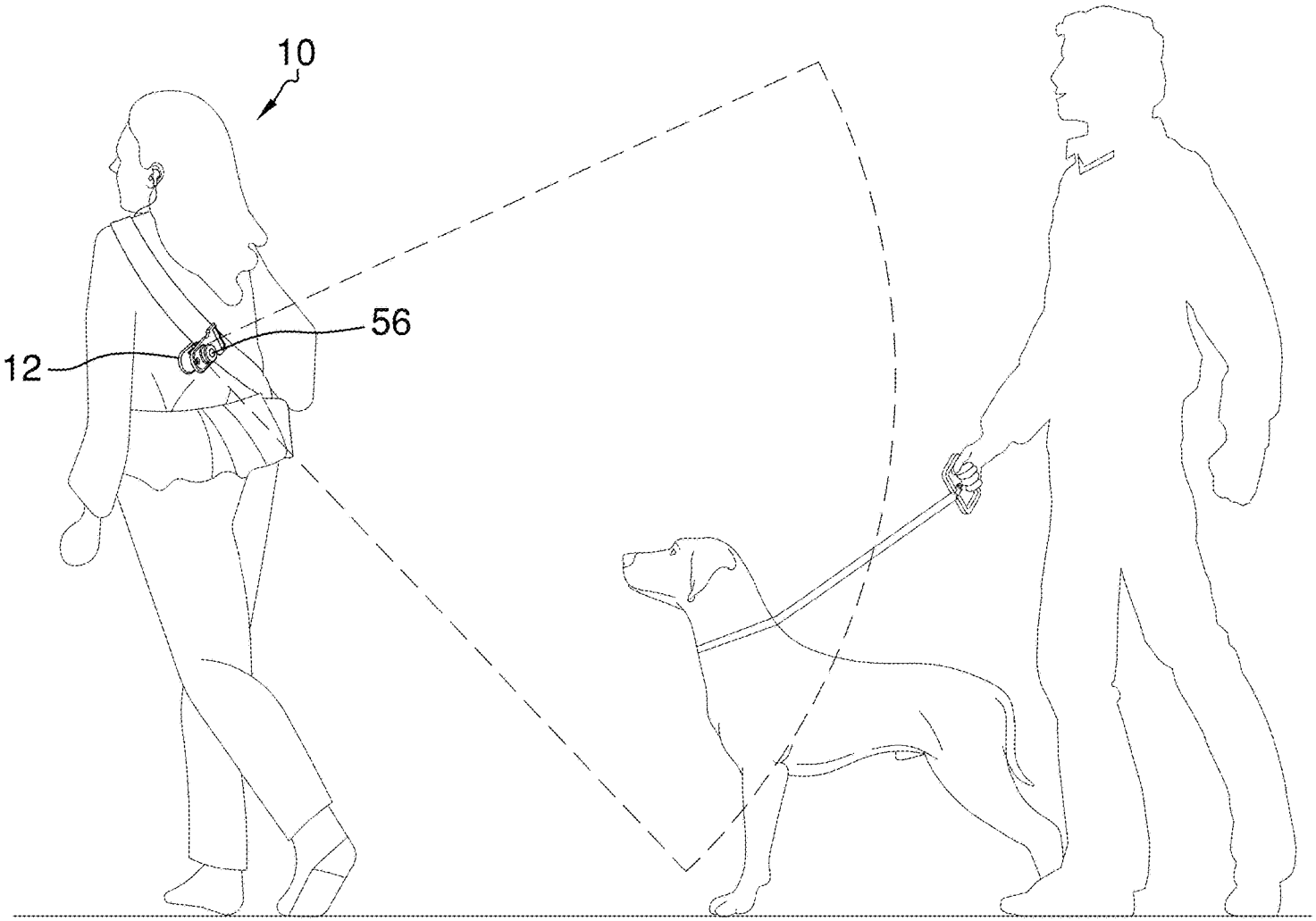
FIG. 5 is an in-use view of an embodiment of the disclosure.

With reference now to the drawings, and in particular to FIGS. 1 through 5 thereof, a new warning device embodying the principles and concepts of an embodiment of the disclosure and generally designated by the reference numeral 10 will be described.

As best illustrated in FIGS. 1 through 5, the personal proximity warning device 10 generally comprises a housing 12 that defines an interior space 14. The housing 12 is configured to couple to an article, such as clothing and straps, that is coupled to a user.

In one embodiment, the housing 12 comprises a first plate 16, a second plate 18, and a biaser 20. The second plate 18 defines the interior space 14. The first plate 16 and the second plate 18 each have a first end 22 and a second end 24. The biaser 20 is coupled to and extends between the first plate 16 and the second plate 18. The biaser 20 is positioned substantially equally distant from the first ends 22 and the second ends 24. The first ends 22 are biased to a closed configuration and the second ends 24 are biased to an open configuration, positioning the second ends 24 to be pinched between digits of a hand of the user. The first ends 22 are separated and configured to insert of a portion of the article, such as the clothing and the straps. The second ends 24 are positioned to be released so that the first ends 22 are compelled by the biaser 20 to the closed configuration to couple the housing 12 to the user.

In another embodiment, the first plate 16 and the second plate 18 are substantially rectangularly shaped. In yet another embodiment, the second ends 24 are rounded.

In one embodiment, the biaser 20 comprises a pair of first tabs 26 that is coupled to and extends from the first plate 16. Each first tab 26 is positioned proximate to a respective opposing edge 28 of the first plate 16. Each of a pair of first holes 30 is positioned through a respective first tab 26. A pair of second tabs 32 is coupled to and extends from the second plate 18. Each second tab 32 is positioned proximate to a respective opposing side 34 of the second plate 18. Each of a pair of second holes 36 is positioned through a respective second tab 32. The first holes 30 and the second holes 36 are alignably positioned. A rod 38 is positioned through the first holes 30 and the second holes 36. A spring 40 is positioned around the rod 38. The spring 40 is positioned to bias the first ends 22 to the closed configuration.

A penetration 42 is positioned through the first plate 16 proximate to the second end 24 of the first plate 16. The penetration 42 is configured to insert a fastener to couple the housing 12 to the article, such as the clothing and the straps.

A power module 44 is coupled to the housing 12 and is positioned in the interior space 14. In one embodiment, the power module 44 comprises at least one battery 46. An opening 48 is positioned through an outer face 50 of the second plate 18 proximate to the power module 44. The interior space 14 is accessible to replace the at least one battery 46. A panel 52 is reversibly couplable to the second plate 18 to selectively close the opening 48.

A transmitter 54 is coupled to the housing 12 and is positioned in the interior space 14. The transmitter 54 is operationally coupled to the power module 44. The transmitter 54 is configured to communicate an alert to an electronic device of the user. The electronic device is configured to audibly communicate the alert to the user through one or more speakers that are coupled to the user, such as earbuds and headphones. In one embodiment, the transmitter 54 is configured to wirelessly communicate the alert to the electronic device of the user. In another embodiment, the transmitter 54 is Bluetooth™ enabled.

A sensor 56 is coupled to the housing 12. The sensor 56 is operationally coupled to the power module 44 and the transmitter 54. The sensor 56 is configured to detect motion in an area proximate to the user. The sensor 56 also is configured to compel the transmitter 54 to communicate the alert upon detection of the motion in the area proximate to the user. In one embodiment, the sensor 56 is positioned on an outer surface 58 of the first plate 16.

In use, the housing 12 is configured to couple to the user, positioning the sensor 56 to detect the motion in the area proximate to the user and to coincidently compel the transmitter 54 to communicate the alert to the electronic device of the user. The electronic device is configured to audibly communicate the alert to the user through the one or more speakers that are coupled to the user, such as the earbuds and the headphones.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A personal proximity warning device comprising:

a housing defining an interior space, said housing being configured for coupling to clothing or straps, that is coupled to a user, such that said housing is coupled to the user;

a power module coupled to said housing and positioned in said interior space;

a transmitter coupled to said housing and positioned in said interior space, said transmitter being operationally coupled to said power module, said transmitter being configured for communicating an alert to an electronic device of the user, such that the electronic device is configured to audibly communicate the alert to the user through one or more speakers coupled to the user;

a sensor coupled to said housing, said sensor being operationally coupled to said power module and said transmitter, said sensor being configured for detecting motion in an area proximate to the user, said sensor being configured for activating said transmitter to communicate the alert upon detection of the motion in the area proximate to the user; and wherein said housing is configured for coupling to the user positioning said sensor for detecting the motion in the area proximate to the user and for coincidently activating said transmitter to communicate the alert to the electronic device of the user, such that the alert is audible to the user; and said housing comprising a first plate and a second plate, said second plate defining said interior space, said first plate and said second plate being substantially rectangularly shaped, said first plate and said second plate each having a first end and a second end, a biaser coupled to and extending between said first plate and said second plate, said biaser being positioned substantially equally distant from said first ends and said second ends, and wherein said biaser is positioned on said first plate and said second plate such that said first ends are biased to a closed configuration and said second ends are biased to an open configuration positioning said second ends for pinching between digits of a hand of the user such that said first ends are separated, configuring said first ends for insertion of a portion of the clothing or the straps, wherein said second ends are positioned for releasing such that said first ends are urged by said biaser to the closed configuration, coupling said housing to the user.

2. The device of claim 1, further including said second ends being rounded.

3. The device of claim 1, further including said biaser comprising:

a pair of first tabs coupled to and extending from said first plate, each said first tab being positioned proximate to a respective opposing edge of said first plate;

a pair of first holes, each said first hole being positioned through a respective said first tab;

a pair of second tabs coupled to and extending from said second plate, each said second tab being positioned proximate to a respective opposing side of said second plate;

a pair of second holes, each said second hole being positioned through a respective said second tab such that said first holes and said second holes are alignably positioned;

a rod positioned through said first holes and said second holes;

a spring positioned around said rod; and wherein said spring is positioned on said rod such that said spring is positioned for biasing said first ends to the closed configuration.

4. The device of claim 1, further including a penetration positioned through said first plate proximate to said second end of said first plate, wherein said penetration is positioned through said first plate such that said penetration is configured for inserting a fastener to couple said housing to the clothing or the straps.

5. The device of claim 1, further including said power module comprising at least one battery.

6. The device of claim 1, further comprising:

an opening positioned through an outer face of said second plate proximate to said power module, wherein said opening is positioned through said outer face such that said interior space is accessible for replacing said at least one battery; and a panel reversibly couplable to said second plate to selectively close said opening.

7. The device of claim 1, further including said transmitter being configured for wirelessly communicating the alert to the electronic device of the user.

8. The device of claim 7, further including said transmitter being Bluetooth™ enabled.

9. The device of claim 1, further including said sensor being positioned on an outer surface of said first plate.

10. A personal proximity warning device comprising:

a housing defining an interior space, said housing being configured for coupling to clothing or straps, that is coupled to a user, such that said housing is coupled to the user, said housing comprising:

a first plate and a second plate, said second plate defining said interior space, said first plate and said second plate being substantially rectangularly shaped, said first plate and said second plate each having a first end and a second end, and a biaser coupled to and extending between said first plate and said second plate, said biaser being positioned substantially equally distant from said first ends and said second ends, wherein said biaser is positioned on said first plate and said second plate such that said first ends are biased to a closed configuration and said second ends are biased to an open configuration positioning said second ends for pinching between digits of a hand of the user such that said first ends are separated, configuring said first ends for insertion of a portion of the clothing or the straps, wherein said second ends are positioned for releasing such that said first ends are urged by said biaser to the closed configuration, coupling said housing to the user, said second ends being rounded, said biaser comprising:

a pair of first tabs coupled to and extending from said first plate, each said first tab being positioned proximate to a respective opposing edge of said first plate, a pair of first holes, each said first hole being positioned through a respective said first tab, a pair of second tabs coupled to and extending from said second plate, each said second tab being positioned proximate to a respective opposing side of said second plate, a pair of second holes, each said second hole being positioned through a respective said second tab such that said first holes and said second holes are alignably positioned, a rod positioned through said first holes and said second holes, and a spring positioned around said rod, wherein said spring is positioned on said rod such that said spring is positioned for biasing said first ends to the closed configuration;

a penetration positioned through said first plate proximate to said second end of said first plate, wherein said penetration is positioned through said first plate such that said penetration is configured for inserting a fastener to couple said housing to the clothing or the straps;

a power module coupled to said housing and positioned in said interior space, said power module comprising at least one battery;

an opening positioned through an outer face of said second plate proximate to said power module, wherein said opening is positioned through said outer face such that said interior space is accessible for replacing said at least one battery;

a panel reversibly couplable to said second plate to selectively close said opening;

a transmitter coupled to said housing and positioned in said interior space, said transmitter being operationally coupled to said power module, said transmitter being configured for communicating an alert to an electronic device of the user, such that the electronic device is configured to audibly communicate the alert to the user through one or more speakers coupled to the user, said transmitter being configured for wirelessly communicating the alert to the electronic device of the user, said transmitter being Bluetooth™ enabled;

a sensor coupled to said housing, said sensor being operationally coupled to said power module and said transmitter, said sensor being configured for detecting motion in an area proximate to the user, said sensor being configured for activating said transmitter to communicate the alert upon detection of the motion in the area proximate to the user, said sensor being positioned on an outer surface of said first plate;

wherein said housing is configured for coupling to the user positioning said sensor for detecting the motion in the area proximate to the user and for coincidently activating said transmitter to communicate the alert to the electronic device of the user, such that the electronic device is configured to audibly communicate the alert to the user through the one or more speakers coupled to the user, such as the earbuds and the headphones.

* * * * *